US005671546A

United States Patent [19]

Haala

[11] Patent Number: 5,671,546

[45] Date of Patent: Sep. 30, 1997

[54] VACUUM REMEDIATION SYSTEM

[76] Inventor: David M. Haala, 804 Third Ave. SW., Sleepy Eye, Minn. 56085

[21] Appl. No.: 572,551

[22] Filed: Dec. 14, 1995

[51] Int. Cl.[6] ..... F26B 13/30

[52] U.S. Cl. ..... 34/92; 34/164

[58] Field of Search ..... 34/531, 538, 562, 34/61, 69, 92, 164, 202, 404, 401, 418, 426, 446, 168

[56] References Cited

U.S. PATENT DOCUMENTS

| | | | |
|---|---|---|---|
| 2,373,841 | 4/1945 | Merrick | 34/1 |
| 2,496,054 | 1/1950 | Hoyler | 34/92 |
| 3,295,492 | 1/1967 | Schink | 34/164 |
| 3,776,599 | 12/1973 | Reuter | 406/15 |
| 3,932,944 | 1/1976 | Chiba | 34/12 |
| 4,020,563 | 5/1977 | Hoefer | 34/92 X |
| 4,319,408 | 3/1982 | Kuboyama | 34/15 |
| 4,570,357 | 2/1986 | Kuboyama | 34/15 |
| 4,816,081 | 3/1989 | Mehta et al. | 134/30 |
| 4,977,688 | 12/1990 | Roberson, Jr. et al. | 34/92 |
| 5,115,576 | 5/1992 | Roberson, Jr. et al. | 34/15 |
| 5,133,136 | 7/1992 | Sykora | 34/15 |
| 5,172,488 | 12/1992 | Okane et al. | 34/15 |
| 5,269,073 | 12/1993 | Johnson | 34/92 X |
| 5,337,497 | 8/1994 | Sato et al. | 34/92 X |
| 5,524,356 | 6/1996 | Lutz | 34/164 |

*Primary Examiner*—John M. Sollecito
*Assistant Examiner*—Steve Gravini
*Attorney, Agent, or Firm*—Nawrocki, Rooney & Sivertson, P.A.

[57] ABSTRACT

A vacuum remediation system for remediating various devices and apparatus is shown. A moisture evaporation device including a vacuum system is described to provide a reduced level of pressure on the apparatus being remediated. A control circuit controls the operation of the moisture vaporization device and includes a timed control operation to limit and actuate operation of the remediation process. A resilient member having a vacuum aperture is described in combination with a removable encapsulation chamber having a fluid-sealing surface to cooperate with the resilient member. A vibration system is adapted to impart low levels of vibration to the apparatus being remediated. The operation is such that unwanted moisture is vaporized through action of a reduced atmospheric pressure produced by the pump, and the vibration in conjunction with the aspiration removes unwanted moisture and contamination particles from the apparatus being remediated.

15 Claims, 4 Drawing Sheets

VACUUM REMEDIATION SYSTEM

BACKGROUND OF THE INVENTION

1. Field of the Invention

This invention relates generally to a system for use in remediation of various types of devices or apparatus. More particularly, it relates to a remediation system that utilizes a vacuum system to aspirate undesired moisture and contamination particles from an apparatus being remediated, under electronic control.

2. State of the Prior Art

It has been recognized that undesired moisture in various types of devices, especially including electronic apparatus, can be detrimental to operation. For apparatus having a sealed container or a substantially air tight container, the concern of having unwanted moisture trapped within is especially difficult to deal with. In such situations it is necessary to open the container sufficiently to allow for the transfer of air and unwanted moisture to the outside.

It is known that unwanted moisture in an apparatus can occur through various phenomena. Moist air can be trapped within the container or cabinet during manufacture, the apparatus can be subjected to moisture that can infiltrate the container, or the apparatus can encounter unwanted moisture through extended physical contact with a person.

The types of apparatus that can be deleteriously affected by the presence of unwanted moisture or contamination include hearing aids, pagers, watches, calculators, and the like. It is known that apparatus worn on or in the human body are especially prone to the development of undesired moisture. Many types of systems have been developed to purify or dry components and apparatus during the manufacturing process. These include various systems for removing undesired moisture from the components of the apparatus during the initial manufacturing process. Many of these systems are extremely complex, expensive, and difficult to operate, and are not available or satisfactory for use in remediating an apparatus after it has been placed in use.

U.S. Pat. No. 3,932,944 issued to Mitsumasa Chiba illustrates an apparatus for preventing the appearance of condensation water droplets inside of a sealed watch crystal. That involves loosening the container, suctioning out the moist air, and inserting dry air passed through a desiccator and a filtering material into the sealed container, and sealing the dried air within the apparatus during a manufacturing process.

U.S. Pat. No 4,319,408 issued to Nobuyoshi Kuboyama describes a drying chamber in which an article to be dried can be placed, and is operable to discharge the air from within the chamber and generate heat to cause drying at a high temperature. This device is described as having utility for drying wet articles such agricultural or marine products, clothes or the like.

U.S. Pat. No. 5,172,488 issued to Masaaki Okane, et al. describes drying of components by placing them in a drum container which can be decompressed and rotated for purposes of stirring a plurality of electronic components and drying them by the addition of heat applied through a heated liquid bath.

Various more complex types of drying and treating systems have been shown for drying substrates or wafers in a semiconductor or similar manufacturing process, some examples including U.S. Pat. Nos. 4,570,357; 4,816,081; 4,977,688; 5,115,576; and 5,133,136. These complex systems in varying combinations involve utilizing a system of generating partial vacuums and applying heat, air, or chemicals in what are generally considered to be clean-room conditions during manufacture. Further, such systems are extremely complex and expensive, and are not readily portable.

To address the deficiencies in the prior art, this invention was developed to provide a low-cost portable system for remediating various kinds of devices without subjecting them to the potential further damage of high levels of heat, vibration or agitation, or other undesirable stress factors, while such remediation of removal of unwanted moisture and contamination particles can improve the operation of the remediated device or apparatus.

SUMMARY OF THE INVENTION

The present invention includes a vacuum remediation system that has a support member having an operational surface to support the apparatus to be remediated, a moisture vaporizing device coupled to the support member, where the moisture vaporizing device includes a vacuum system to provide a reduced level of pressure on the apparatus to be remediated, and a control circuit that can be selectively actuated to limit the operation of the moisture vaporizing device, whereby undesired moisture and contamination particles are aspirated from the apparatus being remediated. The support member can include a resilient member that has a vacuum aperture and a fluid-sealing surface. The improved system can function in one mode with a flexible hose inserted in the vacuum aperture of the resilient member and the other end available to use on the surfaces of the apparatus to be remediated for removal of moisture and contamination particles. The system can also be utilized with a removable encapsulation chamber that has a fluid-sealing surface that operates with the surface of the resilient member and is available to encapsulate the apparatus to be remediated. In this latter arrangement, the vacuum system draws down the pressure within the encapsulation chamber and establishes a condition such that unwanted moisture within the encapsulation chamber and the apparatus is vaporized and aspirated. The system utilizes an actuatable control circuit for providing power to the vacuum system and includes a timer that can be preset to determine the duration of operation of the remediation system and to terminate operation upon expiration of the predetermined time.

The apparatus to be remediated is placed on a resilient member that has a vacuum aperture that is piped to the intake port of a pump and encapsulation chamber is placed over the apparatus to be remediated and is placed in contact with the surface of the resilient member. When the pump is activated to aspirate fluid through the vacuum aperture, the fluid-sealing surface on the encapsulation chamber cooperates with the resilient member to provide a fluid seal to allow pressure to be reduced within the encapsulation chamber. As the fluid within the encapsulation chamber is aspirated, moisture within the chamber and on and within the apparatus being remediated is caused to be vaporized. The vibration of the pump in conjunction with the resilient member vibrates the apparatus at a low level of vibration and assists in reducing the surface tension of contamination particles and undesired moisture, and assists in the remediation process. A control circuit is preset to a predetermined duration for the operation of the entire system. When the system is turned on, the timer is activated and allows the pump to operate for the preset duration of the timer to remediate the apparatus through the aspiration of the undesired moisture and contamination particles. Different types of apparatus may require different settings of the timer. When the remediation process is completed, a release valve can be actuated to equalize the pressure within the removable encapsulation chamber thereby allowing the seal to the resilient member to be broken so that the encapsulation chamber can be removed and the apparatus to thereby be exposed.

The various scopes and aspects of the invention, as well as other more detailed objectives and advantages thereof, will be more readily apparent from the following detailed description of the accompanying drawings.

DETAILED DESCRIPTION OF THE PREFERRED EMBODIMENT

Figure 1:
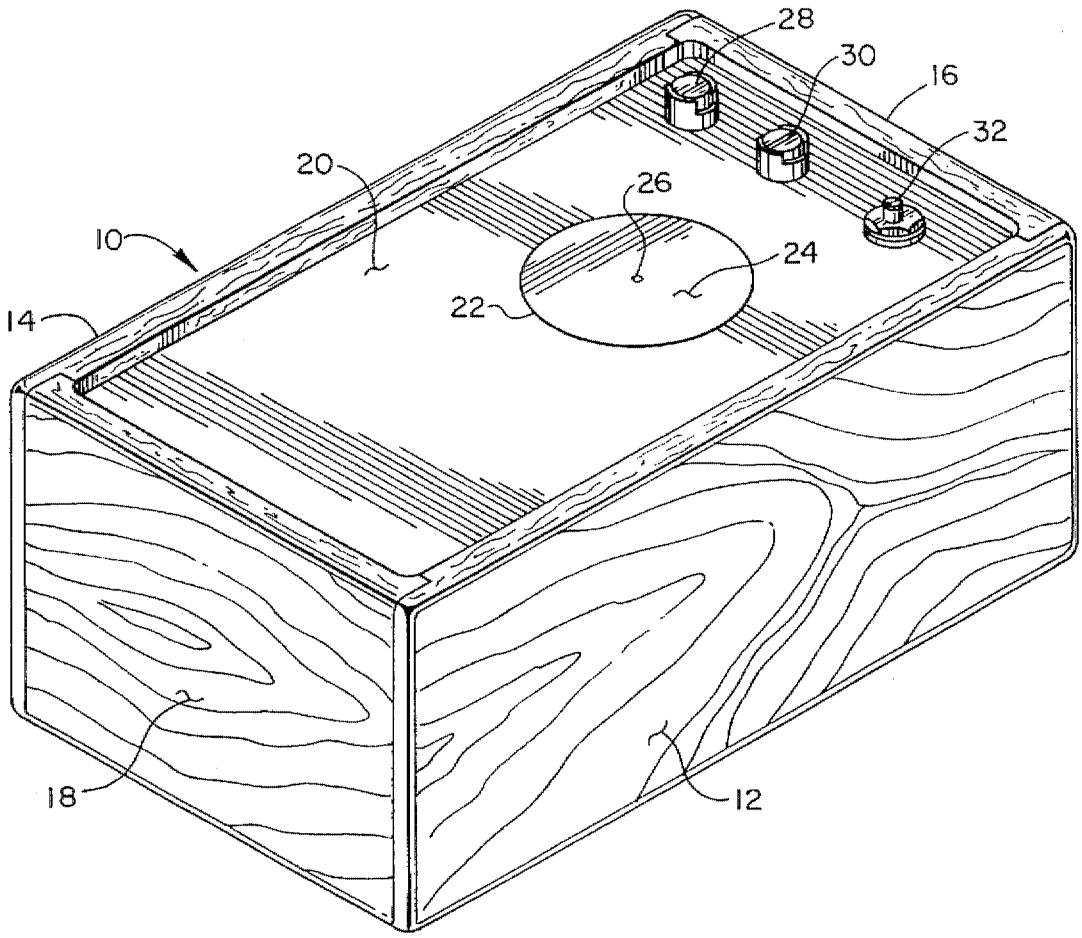
FIG. 1 is a perspective view of the cabinet of the remediation system.

FIG. 1 is a perspective view of the cabinet of the remediation system. The cabinet 10 has two side members 12 and 14, and a pair of end members 16 and 18. An upper work surface 20 has a mounting aperture 22 in which is mounted a resilient member 24. Resilient member 24 has a vacuum aperture 26 and is substantially compliant. The resilient member can be fashioned from rubber or rubber-like material. In this configuration, the resilient member 24 has a diameter of about three inches, and a thickness of about one-fourth inch. A push-on, push-off switch 28 is utilized to turn the system on and off. A push button switch 30 is utilized to commence the remediation process when the system is turned on. A vacuum release switch 32 is utilized to release the vacuum when the remediation process is completed. In operation, an apparatus to be remediated, such as a hearing aid (not shown), is placed on the resilient member and an encapsulation chamber such as a bell jar (see FIG. 3) is placed over the apparatus and forms a fluid-seal with the resilient member 24.

Figure 2:
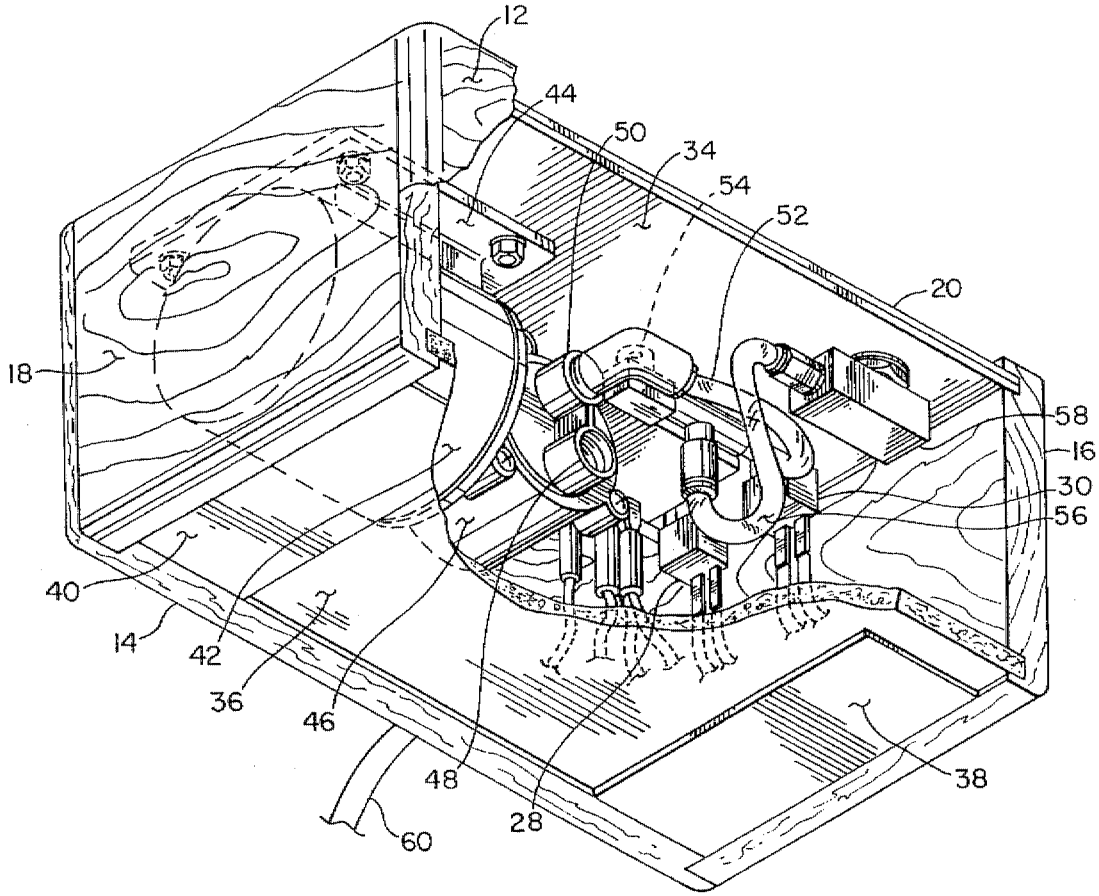
FIG. 2 is a partially cut-away perspective view illustrating the components and interconnections of the vacuum remediation system.

FIG. 2 is a partially cut-away perspective view illustrating the components and interconnections of the vacuum remediation system. Beneath upper work surface 20 there is located a component mounting member 34 that supports the various components of the vacuum remediation system. Component mounting member 34 is fabricated from a plastic material and is supported by the sides 12 and 14 and the ends 16 and 18. This view illustrates the underside 36 with cushion foot pads 38 and 40.

An electric motor 42 is mounted by mount 44 to mounting member 34. Motor 42 drives pump 46 when power is applied. Pump 46 is driven by motor 42 and has an exhaust port 48 and a vacuum port 50. Vacuum port 50 is coupled via hose 52 to vacuum orifice 54 and via tubing 56 to check valve 58. Check valve 58 is actuated through depression of switch 32 (see FIG. 1). Vacuum orifice 54 cooperates with the vacuum aperture 26 in resilient member 24. When motor 42 and pump 46 are in operation, a pulsation or vibration are imparted to support member 34 and to resilient member 24, which in turn applies a low level vibration or pulsation to the apparatus being remediated. Switches 28 and 38 will be described in more detail below. A power cord 60 is shown foreshortened and would have a plug (not shown) to plug into an outlet to receive normal 110 volt AC 60 cycle power.

Figure 3:
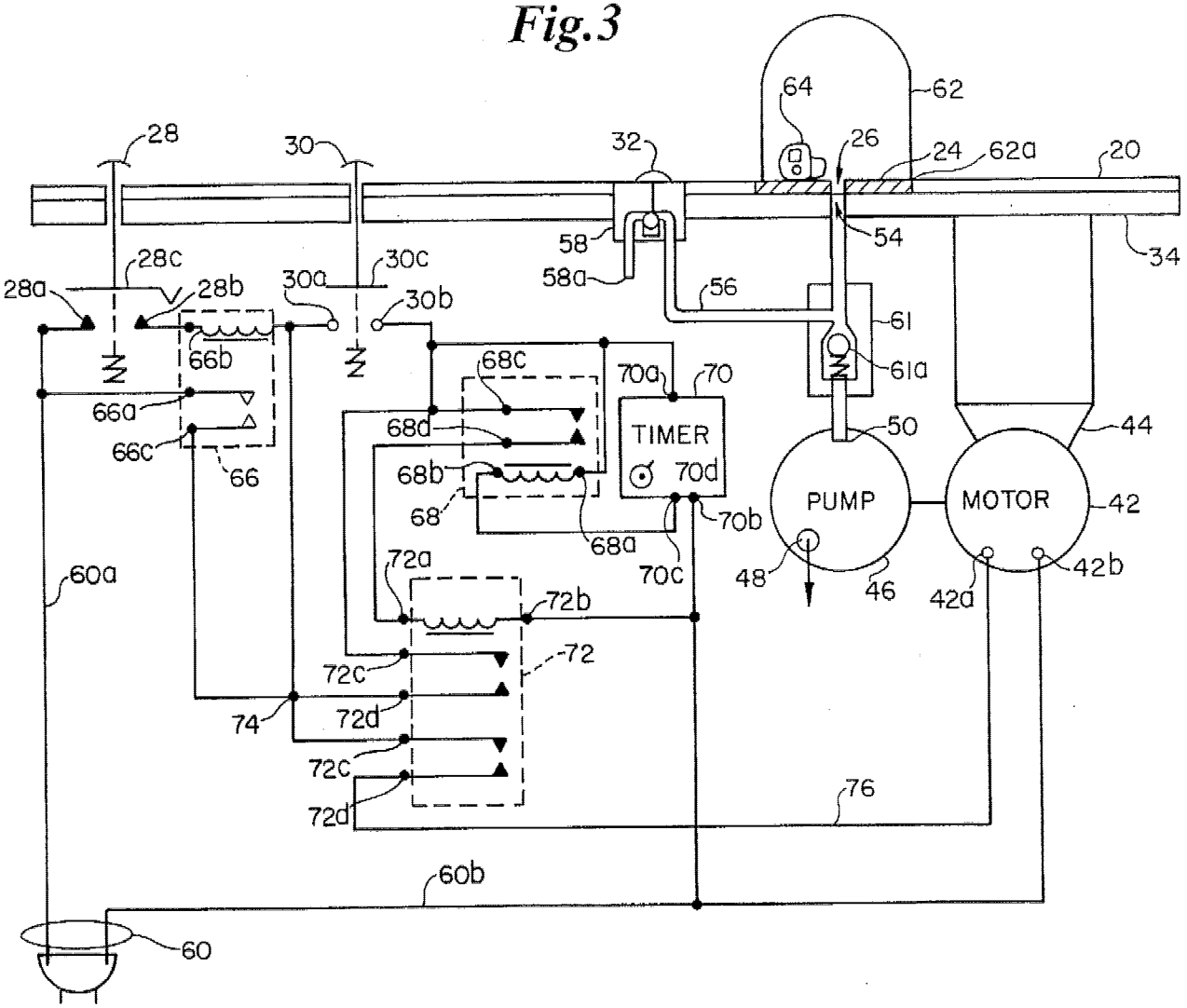
FIG. 3 is a schematic diagram of the elements of the vacuum remediation system.

FIG. 3 is a schematic diagram of the elements of the vacuum remediation system. The upper work surface 20, the resilient member 24, and the component mounting member 34 are shown diagrammatically on edge. Motor 42 is shown mounted via mount 44 to the underside of component mounting member 34. As previously described, pump 46 is mounted to and driven by motor 42. Vacuum port 50 of pump 46 is coupled to check valve 61 which is in fluid communication with vacuum orifice 54. Vacuum orifice 54 is arranged for cooperation with vacuum aperture 26 in resilient member 24. Check valve 61 operates such that when pump 46 is drawing down pressure, ball **61*a* moves downward to allow fluid flow past it. When pump 50 is not in operation, ball 61*a* is formed into a sealing relationship with its seat and reduced pressure is maintained. Check valve 58 is coupled via tubing 56 to check valve 61, and is operative upon completion of the remediation process when switch 32 is depressed, to allow fluid flow in through input port 58*a*, through tube 56, and through vacuum orifice 54**, to thereby equalize pressure to ambient atmosphere.

A bell jar 62 is illustrated with its lower surface **62*a* in contact with the surface of resilient member 24. For purposes of illustration, an apparatus 64** represents the apparatus to be remediated, and illustratively can be a hearing aid.

Operation of the system is controlled by master on-off switch 28 and activation switch 30. On-off switch 28 is a latching switch that is push-on push-off in operation. This is well-known operation that results in continuous electrical contact between its contacts **28*a* and 28*b* when contactor 28*c*** is depressed.

Activation switch 30 is a momentary contact switch and maintains contact between its terminals **30*a* and 30*b* by contact 30*c* only while switch 30 is depressed. Upon release of switch 30**, the contact is broken.

Electrical power is provided on wire pair 60. One of the power lines **60*a* is coupled to switch contact 28*a*. A relay is shown within dashed block 66 and has one of its normally opened contacts 66*a* coupled to power line 60*a*. One end of relay coil 66*b* is coupled to switch contact 28*b*, and the other terminal of relay coil 66*b* is coupled to switch contact 30*a***.

A relay shown in dashed block **68*a* operates in conjunction with a timer 70. Timer 70*a* is coupled to contact 30*b* and to relay coil contact 68*a*. Timer terminal 70*b* is coupled to power line 60*b*. Timer terminal 70*c* is coupled to relay coil terminal 68*b*. Timer 70 may be set in the duration of its time by adjustment 70*d*, and is operative upon expiration of the preset time to close the circuit for relay 68** to thereby open the normally closed contacts, thereby shutting down the system.

A third relay is shown enclosed within dashed block 72 and has one coil terminal **72*a* coupled to normally closed contact terminal 68*d* of relay 68. Coil terminal 72*b* is coupled to power line 60*b*. Normally opened contact terminal 72*c* is coupled to normally closed contact 68*c* and to switch terminal 30*b*. Mating normally opened contact terminal 72*d* is coupled to switch terminal 30*a* and to normally opened switch contact 66*c*. Normally opened contact terminal 72*c* is coupled to junction 74. Normally opened contact terminal 72*d* is coupled via line 76 to motor terminal 42*a*. Power line 60*d* is coupled to motor terminal 42*b***.

In operation, relay 66 is basically a power handling relay that allows switch 28 to carry a minimal current when relay 66 is activated, with power being directed through the relay contacts. For those configurations where motor 42 is of a size such that switch 28 can carry the load current, relay 66 can be omitted.

To understand the operation of the circuit then, consider that switch 28 is depressed and latched. Power will be provided from terminal 28*a* through 28*c* to 28*b* through coil 66*b* of relay 66 and to junction 74. Since neither of the sets of contacts of relay 72 are closed, nothing will happen in the circuit at this time, and power will not be provided to the motor 42.

Upon the momentary depression of switch 30, a circuit will be completed through contact 30*a*, contact 30*c* and contact 30*b* to provide a power path to timer terminal 70*a*, relay coil terminal 68*a*, and normally closed contact 68*c*. Since the contacts of relay 68 are normally closed, the circuit will be completed through contact 68*b* to relay coil terminal 72*a*. Since power is applied to terminal 78*b*, relay 72 will be activated and close both of the two normally opened sets of contacts. With the closure of the contacts of relay 72, power will pass through terminal 78*c* through the contacts and from terminal 72*d* to the motor and power will be activated. At the same time, the circuit will be completed from terminal 74 through switch contact 72*d*, through the contact terminal 72*c*, and back to terminal 68*c*. The function of this pair of contacts in relay 72 and the normally closed contacts of relay 68 will result in the circuit being held active even when switch 30 is released.

When the circuit is completed by depressing switch 30, relay 66 will be activated and the normally opened contacts will be closed. This allows power to be passed through the relay contacts rather than through the switch for purposes of driving the motor, as previously described.

When timer 70 functions to determine that the predetermined elapsed time has occurred, the circuit to relay coil terminal 68*b* will be activated and the normally closed contacts will be opened thereby breaking the circuit and deactivating terminal 72*a* such that relay 72 is deactivated and the contacts return to the normally opened position.

Should it be desired to terminate operation of the device prior to expiration of the timer 70 control, switch 28 can be released, thereby deactivating relay coil 66*b* and allowing its normally opened contacts to open. In this manner, it can be seen that switch 28 is the master control.

All of the components described are commercially available and are known. It is, of course, apparent that various types of motors, pumps, switches, relays, and timers can be selected from components available commercially. It is also clear that other components and configurations of electronic control could be utilized to accomplish the electronic control of the vacuum remediation system. For example, electronic switching circuitry could be substituted for the relays, and the timer can be selected from electronic, mechanical, or electro-mechanical models.

Figure 4:
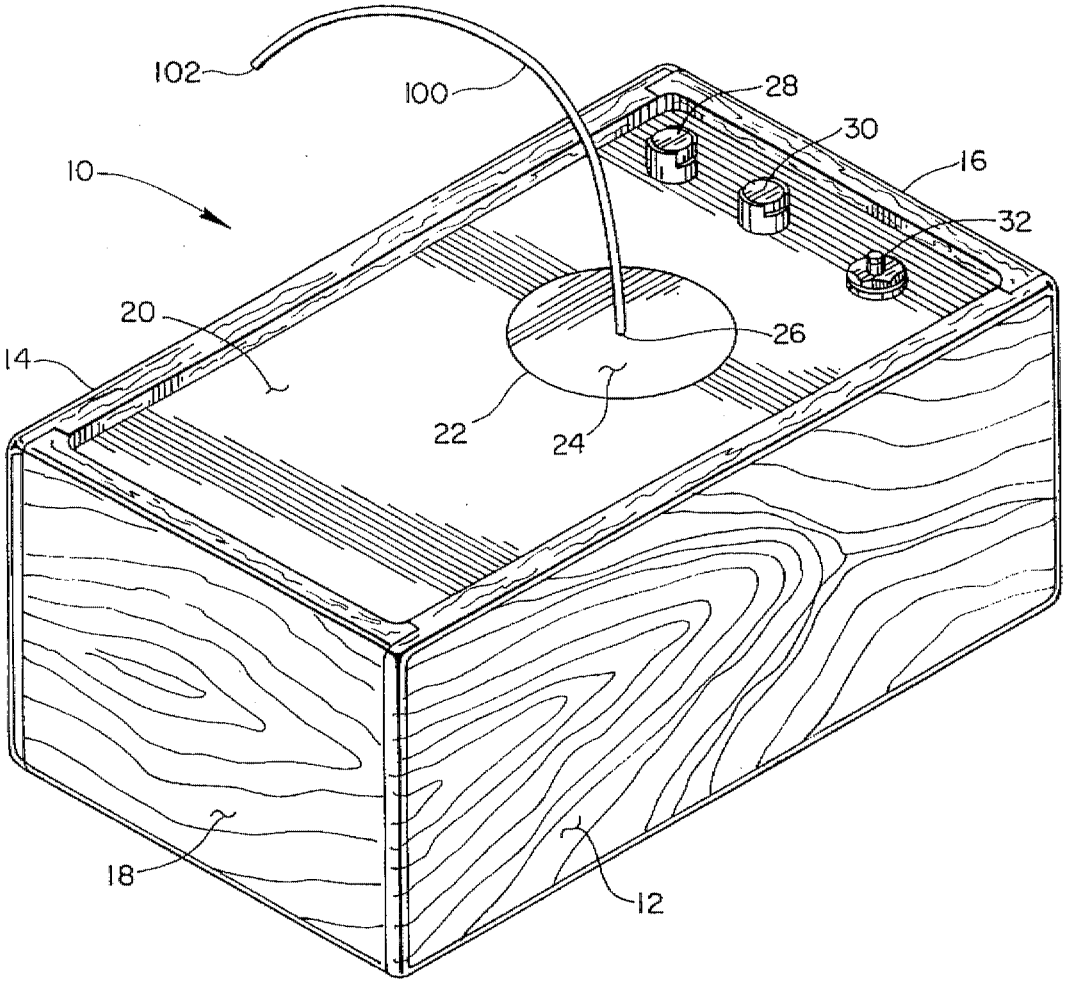
FIG. 4 is a perspective view of the cabinet together with a hose utilized for withdrawing moisture and contamination particles through a suction process.

FIG. 4 is a perspective view of the cabinet together with a hose utilized for withdrawing moisture and contamination particles through a suction process. A flexible hose 100 has one end inserted in the vacuum aperture 26 of resilient member 24 to cooperate with vacuum orifice 54. End 102 of hose 100 can be applied to the surface of an apparatus (not shown) to be remediated to provide a suction action for the aspiration of undesired moisture and contamination particles.

In the preferred embodiment, the overall dimensions of the vacuum remediation system are about 13 inches in width by about eight inches in depth by about six inches in height and weighs about nine pounds. The system is completely portable and can be operated on household 110 volt AC power.

OPERATION

Hearing aids are a common type of apparatus requiring remediation. Hearing aids are commonly worn in or in proximity to the ear and are generally of a small construction. In general, hearing aids will be subject to damage if exposed to high heats or extreme vibrations. Accordingly, it is necessary that hearing aids, as well as other types of electronic apparatus, be handled in a manner to avoid damage to their operability. Through contact with the wearer, hearing aids are prone to incur contamination particles and unwanted moisture to a level that the operability of the hearing aid is impaired. To remediate a hearing aid it is necessary to remove the contamination particles and the undesired moisture.

In operation, the apparatus such as the hearing aid is placed on the resilient member 24 and bell jar 62 is utilized to encapsulate the apparatus. The lip of bell jar 62 comes in contact with the surface of resilient member 24 and, when a vacuum is drawn, forms a fluid seal therewith. The activation of switch 28 conditions the control circuit for operation, and when switch 30 is depressed, power is applied to motor 42 causing pump 46 to draw air from within bell jar 62 and exhaust it through exhaust port 48. The function of pump 46 is selected to reduce the pressure within bell jar 62 to a range of about 22 to 29 inches, and is sufficient to vaporize moisture within the bell jar and on and within the apparatus such as a hearing aid. Mounting member 34 is somewhat flexible and the operation of motor 42 and pump 46 causes mounting member 34 to act somewhat as a diaphragm to thereby impart a low level of vibration to resilient member 24. This vibration in turn is imparted to the apparatus being remediated and assists in the release of the surface tension of moisture and contamination particles, and assists in the aspiration of these elements through exhaust port 48. When the system is activated, timer 66 is preset to a predetermined duration of operation. Characteristically, the timer is set in the range of three to five minutes though circuit operation can be extended to beyond 15 minutes. When the timer 66 determines that the preset time has expired, the circuit is opened and motor 42 is disabled, thereby causing pump 46 to discontinue pumping. To release the vacuum within bell jar 62, switch 32 is depressed to release the check valve and allow the pressure within bell jar 62 to be reestablished at atmospheric pressure.

It should be noted that corrosion, crusted on materials, or cerumen lodged in the hearing aid will not be remediated by this process, and would require other forms of remediation.

In addition to the use of the vaporization system utilizing the bell jar, the vacuum remediation system can also be utilized with the tubing 100 to suction off moisture and contamination from apparatus that cannot be fit in the bell jar, or from locations within the apparatus that do not lend themselves to remediation through the vaporization and vibration process.

It can be seen from the foregoing description of the preferred embodiment and the operation thereof that the objectives of providing an inexpensive, portable, and safe vacuum remediation system has been achieved. The life of apparatus remediated can be extended and the performance improved through use of the vacuum remediation system.

Having described the preferred embodiment of the invention in conjunction with the drawings, it can be seen that the various stated purposes and objectives have been achieved, and that there are modifications and extensions that will become apparent to those skilled in the art within the spirit and scope of the invention. Accordingly, what is intended to be protected by Letters Patent is set forth in the appended claims.

What is claimed is:

1. For use in remediating apparatus, a vacuum remediation system comprising:

vacuum application means for applying a vacuum to the apparatus to be remediated;

vacuum means coupled to said vacuum application means for providing a reduced pressure sufficient to vaporize and evacuate moisture from the apparatus to be remediated;

control means coupled to said vacuum means for controlling the remediation of the apparatus; and pulsation means for providing vibration to the apparatus being remediated for assisting in removing moisture vapor and contamination particles from the apparatus being remediated.

2. A vacuum remediation system as in claim 1, wherein said vacuum application means includes:

encapsulation means for enclosing the apparatus.

3. A vacuum remediation system as in claim 1, wherein said vacuum application means includes:

hose means for selectively applying vacuum to the apparatus.

4. A vacuum remediation system as in claim 2, wherein said encapsulation means includes:

resilient support means for supporting the apparatus, said resilient support means having an aperture for cooperating with said vacuum means; and enclosure means for enclosing the apparatus and for providing a vacuum seal to said resilient support means.

5. A vacuum remediation system as in claim 1, wherein said control means includes:

timer means for controlling the duration of operation of said vacuum means.

6. A vacuum remediation system as in claim 5, wherein said timer means includes:

adjustment means for selectively adjusting the duration of operation of said vacuum means.

7. A vacuum remediation system as in claim 5, wherein said control means further includes:

vacuum release means for selectively releasing the vacuum formed in said encapsulation means by said vacuum means.

8. A vacuum remediation system as in claim 1, wherein said control means includes:

power receiving means for coupling to a source of electrical power;

ready means coupled to said power receiving means and to said vacuum means for selectively activating said control means to a ready state;

timer means coupled to said power receiving means and to said vacuum means for controlling the duration of operation of said vacuum means;

activation means coupled to said timer means for activating operation of said vacuum means.

9. For use in removing undesired moisture and contamination particles from an apparatus, a vacuum remediation system comprising:

a support member having an operation surface to support the apparatus to be remediated;

a moisture vaporization device coupled to said support member, said moisture vaporization device including a vacuum system adapted to provide a reduced level of pressure on the apparatus to be remediated;

a control circuit coupled to said moisture vaporization device, said control circuit including a selectively actuatable circuit to limit and actuate operation of said moisture vaporization device;

whereby undesired moisture and contamination particles are removed from the apparatus to be remediated; and a vibration system adapted to impart a predetermined level of vibration to the apparatus to be remediated, said predetermined level of vibration enhancing vaporization of undesired moisture and loosening contamination particles.

10. A vacuum remediation system as in claim 9, wherein said vacuum system includes:

a resilient member supported by said support member, said resilient member having a vacuum aperture therethrough and a fluid-sealing surface; and a removable encapsulation chamber having a fluid-sealing surface to operate in cooperation with said fluid-sealing surface.

11. A vacuum remediation system as in claim 9, wherein said vacuum system includes:

a vacuum aperture having a predetermined opening configuration; and a flexible hose having first and second ends with at least said second end having a cross-section configuration substantially equal to said predetermined opening and slidably engaged therewith to substantially form a vacuum seal.

12. For use in remediating an apparatus by removing undesired moisture and contamination particles from the apparatus, an electrically operable vacuum remediation system comprising:

a housing having an operation surface, said operation surface having a mounting aperture;

a resilient member mounted in said mounting aperture, said resilient member having a vacuum aperture therethrough and a fluid-sealing surface;

a power receiving circuit adapted to be coupled to a source of electrical power;

a pump mounted within said housing, said pump having an exhaust port and an input port coupled to said vacuum aperture;

a motor coupled to said power receiving circuit and connected to said pump to cause said pump to operate when electrical power is provided to said power receiving circuit and applied to said motor;

a removable apparatus encapsulation chamber having a fluid-sealing surface to operate in cooperation with said fluid-sealing surface to inhibit flow of fluid therebetween;

an actuatable control circuit having a power circuit coupled to said power receiving circuit, said power circuit to apply electrical power to said motor when actuated and having a selectively actuatable circuit to limit and actuate said power circuit;

whereby said pump reduces fluid pressure within said removable apparatus encapsulation chamber thereby causing vaporization of moisture on and in said apparatus and aspirates vaporized moisture and contamination particles through said vacuum aperture and out said exhaust port, said pump being mounted in a predetermined proximity to said resilient member to cause said resilient member to vibrate in response to operation of said pump, the apparatus being remediated being subjected to vibration in a manner to improve vaporization of undesired moisture and to loosen contamination particles.

13. An electrically operable vacuum remediation system as in claim 12, and further including:

a flexible hose having a predetermined length and first and second ends, and at least said first end of a size to slidably insert in said vacuum aperture and form a substantial vacuum seal with said resilient member.

14. An electrically operable vacuum remediation system as in claim 12, wherein said actuatable control circuit includes:

a timer circuit for controlling the duration of operation of said pump.

15. An electrically operable vacuum remediation system as in claim 12, wherein said actuatable control circuit includes:

a ready switch coupled to said power receiving circuit for selectively activating said actuatable control circuit;

a timer circuit coupled to said power receiving circuit and to said motor to power to said motor for a predetermined amount of time; and an activation switch coupled to said timer circuit to apply power to said motor when activated.

* * * * *